US005227851A

United States Patent [19]

Yoshida et al.

[11] Patent Number: 5,227,851

[45] Date of Patent: Jul. 13, 1993

[54] IMAGE-FORMING APPARATUS IN WHICH THE IMAGE TRANSFERRING MEANS IN A PLATE SHAPED ELASTIC MEMBER

[75] Inventors: Minoru Yoshida, Tokyo; Kouji Hirano, Kanagawa, both of Japan

[73] Assignee: Kabushiki Kaisha Toshiba, Kawasaki, Japan

[21] Appl. No.: 885,672

[22] Filed: May 19, 1992

[30] Foreign Application Priority Data

Jun. 28, 1991 [JP] Japan ..... 3-159010
Jun. 28, 1991 [JP] Japan ..... 3-159013

[51] Int. Cl.[5] ..... G03G 15/14

[52] U.S. Cl. ..... 355/271; 355/274; 361/225

[58] Field of Search ..... 355/271, 274, 276, 219, 355/203, 208; 361/225, 230; 250/324–326

[56] References Cited

U.S. PATENT DOCUMENTS 4,341,456 7/1982 Iyer et al. ..... 355/274
4,571,052 2/1986 Shirai ..... 355/274

FOREIGN PATENT DOCUMENTS 48-51640 7/1973 Japan .
48-68239 9/1973 Japan .
0029838 3/1980 Japan ..... 355/271
58-102278 6/1983 Japan .
0137178 6/1986 Japan ..... 355/274
0232478 10/1986 Japan ..... 355/271
0131884 6/1991 Japan ..... 355/271

*Primary Examiner*—A. T. Grimley
*Assistant Examiner*—William J. Royer
*Attorney, Agent, or Firm*—Foley & Lardner

[57] ABSTRACT

A transferring device in an image forming apparatus is provided which includes a plate-shaped member for transferring a developed image formed on an image carrier onto an image receiving medium. The plate-shaped member has an elasticity and electrical conductivity to press the image receiving medium to the surface of the image carrier. The plate-shaped member is moved between a first position where the plate-shaped member contacts the surface of the image carrier through the image receiving medium and a second position where the plate-shaped member separates from the image carrier.

6 Claims, 10 Drawing Sheets

IMAGE-FORMING APPARATUS IN WHICH THE IMAGE TRANSFERRING MEANS IN A PLATE SHAPED ELASTIC MEMBER

BACKGROUND OF THE INVENTION

1. Field of the Invention

The present invention relates to a transferring device in an image forming apparatus, which transfers a developed image obtained by developing an electrostatic latent image formed on an image carrier to an image receiving medium such as a paper.

2. Description of the Related Art

In image forming apparatuses such as an electrophotographic apparatus or electrostatic printers, devices using an electrostatic transferring method, such as corona transferring or roller transferring and devices using mechanical transferring such as an adhesion transferring, are known as transferring devices. Within these, devices employing a corona transferring method are in wide use.

In recent years, the emission of ozone by corona discharge became a harmful problem. Thus, roller transferring methods, in which there is little generation of ozone have come into use. Also, as the applied voltages used for contact transferring methods, such as the roller transferring method, are lower than those used in corona transferring methods they have advantages in terms of safety. However, although roller transferring methods have this advantage, there are several reasons why they have not become widely used. In roller transferring methods, it is required to press an image receiving medium (paper, etc.) against an image carrier such as a photosensitive drum with a suitable pressure. If this pressure is too light, there will be transfer misses, while if this pressure is excessive, the developing agent (toner) may form blots on the paper and cause transfer failure. Consequently it is necessary to have a high degree of mechanical precision (straightness of about $\pm 50$ $\mu$m) and suitable flexibility (JIS hardness about 10–40 degrees). However, it has been difficult to meet both of these requirements with the conductive rubber used in the prior art. For example, if transfer onto thick paper is effected, excessive pressure is produced and transfer faults occur. Also, differences among many apparatuses arise, depending on the transfer roller or the precision of mounting.

In order to transfer developing agent electrostatically, the material used must prevent destruction of the image carrier by electrical discharge in all environments and maintain a resistance value capable of transferring well and this restricts the possible range of mechanical properties. Other factors which make the selection of material more stringent include the desire to prolong the life of the transferring roller (to, for example, a life of some tens of thousands of transfers) which involves the necessity of cleaning the roller surface and maintaining the smoothness of the roller surface. If the roller is not cleaned, the reverse surfaces of the paper become soiled. Generally, rubber material has a rough surface and its frictional resistance is large. Therefore, although practices, such as dispensing with cleaning and making early replacements of rollers and providing highly smooth material on the roller surface and cleaning it, have been tried. However, if a surface layer is placed on the rubber roller, the resilience of the rubber is adversely affected and there is failure to meet required characteristics. Pricewise the product becomes more costly than a corona transferring device.

Given this background, there is a demand for an image forming apparatus which resolves the above problems and satisfactorily provides all required characteristics.

SUMMARY OF THE INVENTION

It is an object of the present invention to provide a transferring device in an image forming apparatus which makes it possible to effect good transfer with little production of ozone and without high mechanical precision being required.

According to the present invention there is provided a transferring device in an image forming apparatus, the device comprising means for transferring a developed image formed on an image carrier onto an image receiving medium. The transferring means, including a plate-shaped member having the elasticity and electrical conductivity to press the image receiving medium to the surface of the image carrier; and means for moving the plate-shaped member of the transferring means between a first position where the plate-shaped member contacts the surface of the image carrier through the image receiving medium and a second position where the plate-shaped member separates from the image carrier.

DETAILED DESCRIPTION OF THE PREFERRED EMBODIMENTS

One embodiment of the invention will now be described with reference to the drawings.

Figure 1:
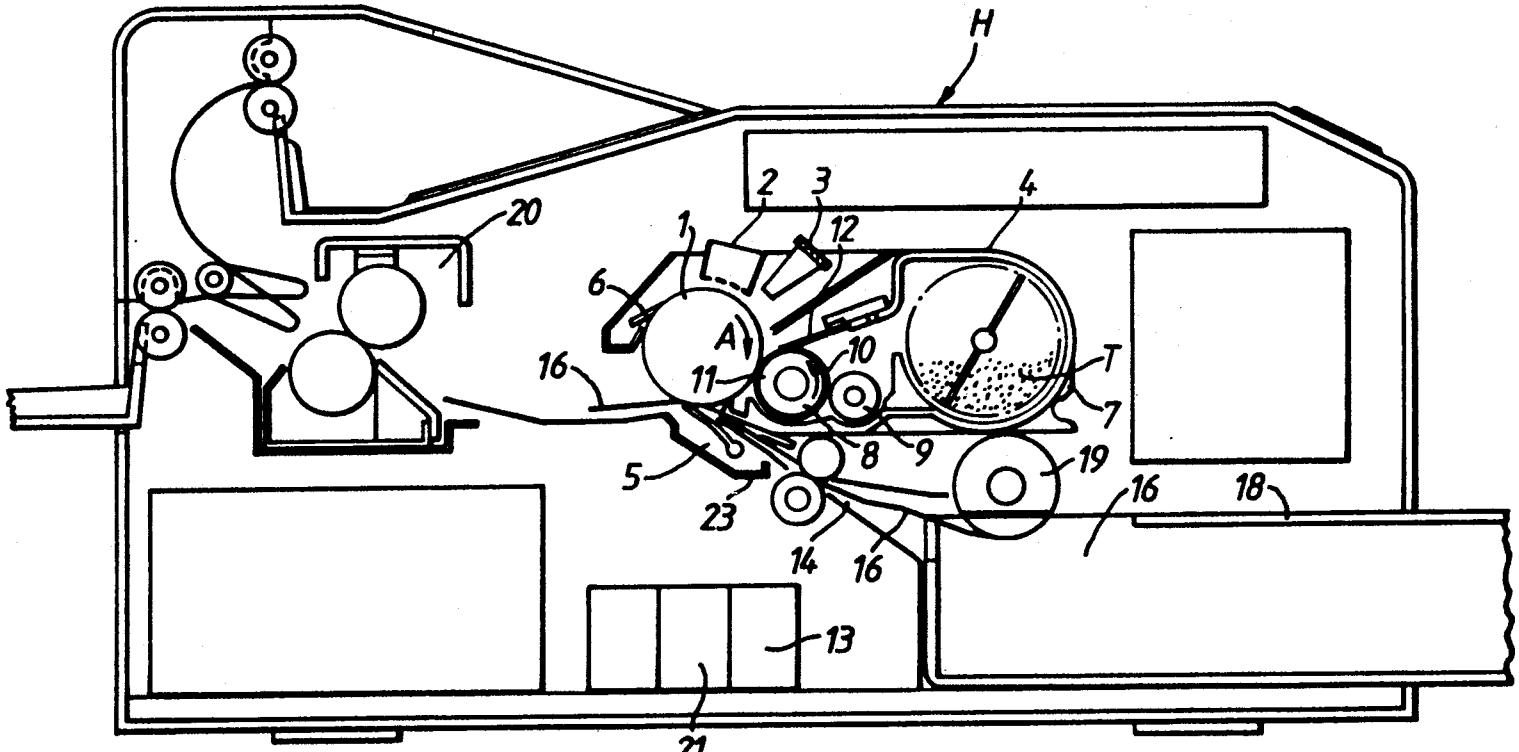
FIG. 1 is a section view showing an image forming apparatus incorporating a transferring device according to one embodiment of the present invention.

FIG. 1 shows an image forming apparatus according to one embodiment of the present invention. In a central portion of appratus' housing H, there is installed photosensitive drum 1 as an image carrier which rotates in the direction of the arrow A. Photosensitive drum 1 is constituted by an organic photoconductor (OPC). Around it are successively provided in the direction of its rotation main charger 2, image exposure device 3 constituted by an LED array, developing/cleaning device 4, transferring device 5 and memory erasure brush 6 constituting a member for dispersing residual toner images after transferring of the toner image. There is no cleaning device for cleaning off the toner remaining after transferring but developing/cleaning device 4 also serves as a cleaning device.

Main charger 2 is arranged above photosensitive drum and acts to charge uniformly the surface of photosensitive drum 1 to −400 to −700 [V]. Image exposure device 3 radiates LED light onto the surface of photosensitive drum 1 and forms an electrostatic latent image corresponding to image information that is to be recorded. Developing/cleaning device 4 comprises hopper 7, intermediate roller 9 and developing roller 8. Hopper 7 contains one-component developer T (called 'toner' below). Toner T has a frictional charging characteristic. Intermediate roller 9 and developing roller 8 are arranged in hopper 7. Intermediate roller 9 actuates to supply toner T to developing roller 8. Developing roller 8 actuates to develop the electorostatic latent image to obtain a toner image on photosensitive drum 1.

Developing roller 8 comprises conductive surface layer 10 constituted by a conductive elastomer whose electrical resistance is $10^2$ to $10^8$ [Ω·cm] and, provided inside this, an elastic layer 11 of foamed urethane, silicone rubber or EPDM, etc. Overall, developing roller 8 possesses elasticity. Bias power source 13 is connected to developing roller 8 via conductive surface layer 10 and at the time of development a developing bias voltage of −140 to −400 [V] is applied.

While toner T is being rubbed on, toner layer forming blade 12 for forming a thin toner layer is pressed against developing roller 8. Toner layer forming blade 12 has a structure in which a semispherical silicone rubber tip with a radius of 1.5 [mm] is mounted on the tip end portion of a 0.15 [mm] phosphor bronze plate. The silicone rubber tip portion contacts developing roller 8. Toner T which passes through this contact portion is friction charged with a negative polarity which is the same as the polarity of the charge of photosensitive drum 1 and formed one to three layers of toner. Toner layer forming blade 12 may also be formed from a rubber tip, like that in this embodiment of the present invention, mounted on an elastic plate or metal block, covered with a coating which readily charges the toner.

Figure 2A:
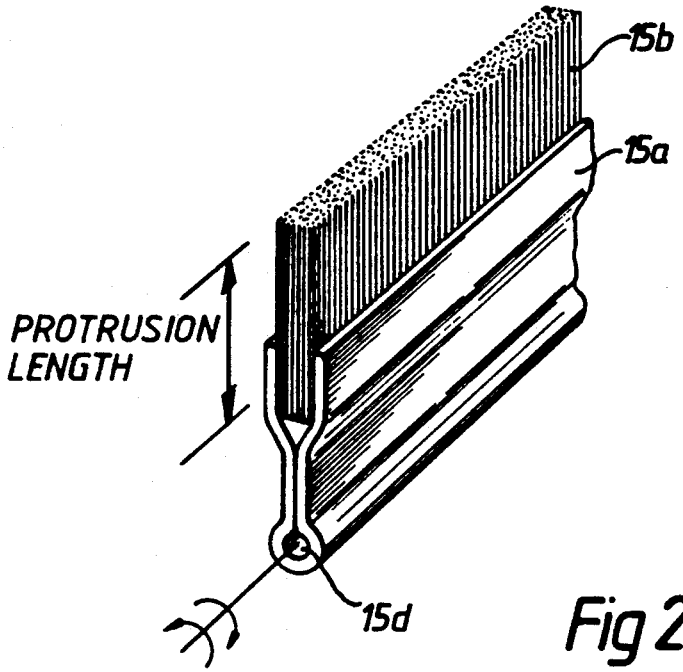
FIG. 2A is a perspective view showing a transferring member constituted by a plate-shaped brush that is used in the image forming apparatus shown in FIG. 1.

Transferring device 5 is arranged below photosensitive drum 1 and faces the peripheral surface of photosensitive drum 1 via paper conveying path 14. As shown in FIG. 2A, transferring device 5 is constituted by support member 15*a* of metal, and paintbrush-shaped transferring brush 15*b* which is formed by conductive fibers being bundled in a suitable density into a plate shape by support member 15*a*. While photosensitive drum 1 rotates, transferring brush 15*b* is in rubbing contact at least over the width of the effective image area of photosensitive drum 1.

A voltage of 600 to 1600 [V] is applied to this transferring brush 15*b*. This voltage is applied through contact on the surface of paper 16 conveyed to the location of transferring brush 15*b* and consequently a toner image on photosensitive drum 1 is electrostatically attracted to and transferred onto paper 16. The brush of transferring brush 15*b* in this embodiment is one in which conductive fibers produced by mixing conductive carbon with rayon are bundled into a plate shape.

Figure 2B:
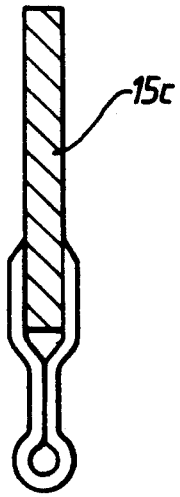
FIG. 2B is a cross sectional view showing a transferring member constituted by a plate-shaped element that is used in the image forming apparatus shown in FIG. 1.

Another embodiment of the transferring device according to the present invention is shown in FIG. 2B. In this case the transferring device consists of plate-shaped member 15*c* consisting of material with excellent wear resistance and which has suitable elasticity and electrical conductivety. A conductive plate-shaped member that is about 0.5 to 2 [mm] thick and is produced by mixing flexible urethane rubber and conductive carbon, or silicone rubber and conductive carbon, can be used as such as member.

The fibers used in a conductive brush may be acrylic fibers or other fibers. As long as they possess suitable pliability and mechanical strength and a prescribed electrical resistance value, any fibers can be used. A further description will now be given with reference to an example in which a rayon brush is used.

Test operations were performed with the following conditions. The electrical resistance of fibers used in the brush were in the range $10^2$ to $10^{10}$ [Ω·cm] and the fiber thickness was in the range 0.5 to 25 [denier]. The length of the brush fibers was in the range 2 to 30 [mm] and the bristle density was in the range 1 to 2,000 [fibers/mm]. The result of these test were that if the length of the fibers was 3 [mm] or less, there was failure to achieve uniform contact on the paper through the elasticity of the brush. While at 25 [mm] or more, it was not possible to achieve satisfactory contact with the photosensitive drum in transfer onto thick paper. When the fibers were too fine, they were too pliable and it was not possible to effect transfer onto thick paper, while if they were too thick the result was that the pressure became excessive and center drop-out occurred in characters. A 1 to 15 [denier] range was good. When the bristle density was made low, there were portions where no charge was produced on the paper and transfer faults occurred. This phenomenon was very marked when transfer onto insulated sheets such as OHP, etc. was effected. It is necessary to have 30 or more [fibers] per 1 [mm] and, as with the fiber thickness, if the bristle density is too small, the brush lacks stiffness and faults occur in transfer onto thick paper. If the electrical resistance of the fibers is too low, the photosensitive drum is damaged, and if it is too high, transfer faults occur. Good transfer without damage to the photosensitive drum was possible at $10^3$ to $10^8$ [Ω·cm].

The results of the above investigation showed that good transfer can be effected by using a transferring brush in which the fiber thickness is 1 to 15 [denier], the electrical resistance of the fiber is $10^3$ to $10^8$ [Ω·cm], the fiber bristle density is 30 [fibers/mm] (preferable 500 [fibers/mm]) or more and the fiber protrusion length is 3 to 25 [mm] and applying a +600 to +1600 [V] bias voltage.

A roller shaped transferring brush and a transferring roller were made in order to compare the performance of the transferring device of the present invention and that of a transferring device using a conventional conductive rubber roller. The transferring brush was roller-shaped, using fibers with a thickness of 6 [denier] and an electrical resistance of $10^6$ [Ω·cm] planted at a density of 1,000 [fibers/mm] and with the brush fiber foot length made 12 [mm]. An element possessing suitable pliability for a transferring roller (JIS hardness 30 [degrees]) was used as the transferring roller. The comparison was made on the basis of the amount of tolerance for press-in of the transferring brush and the transferring roller, i.e., the required mechanical precision. The test results are shown in FIG. 3.

Figure 3:
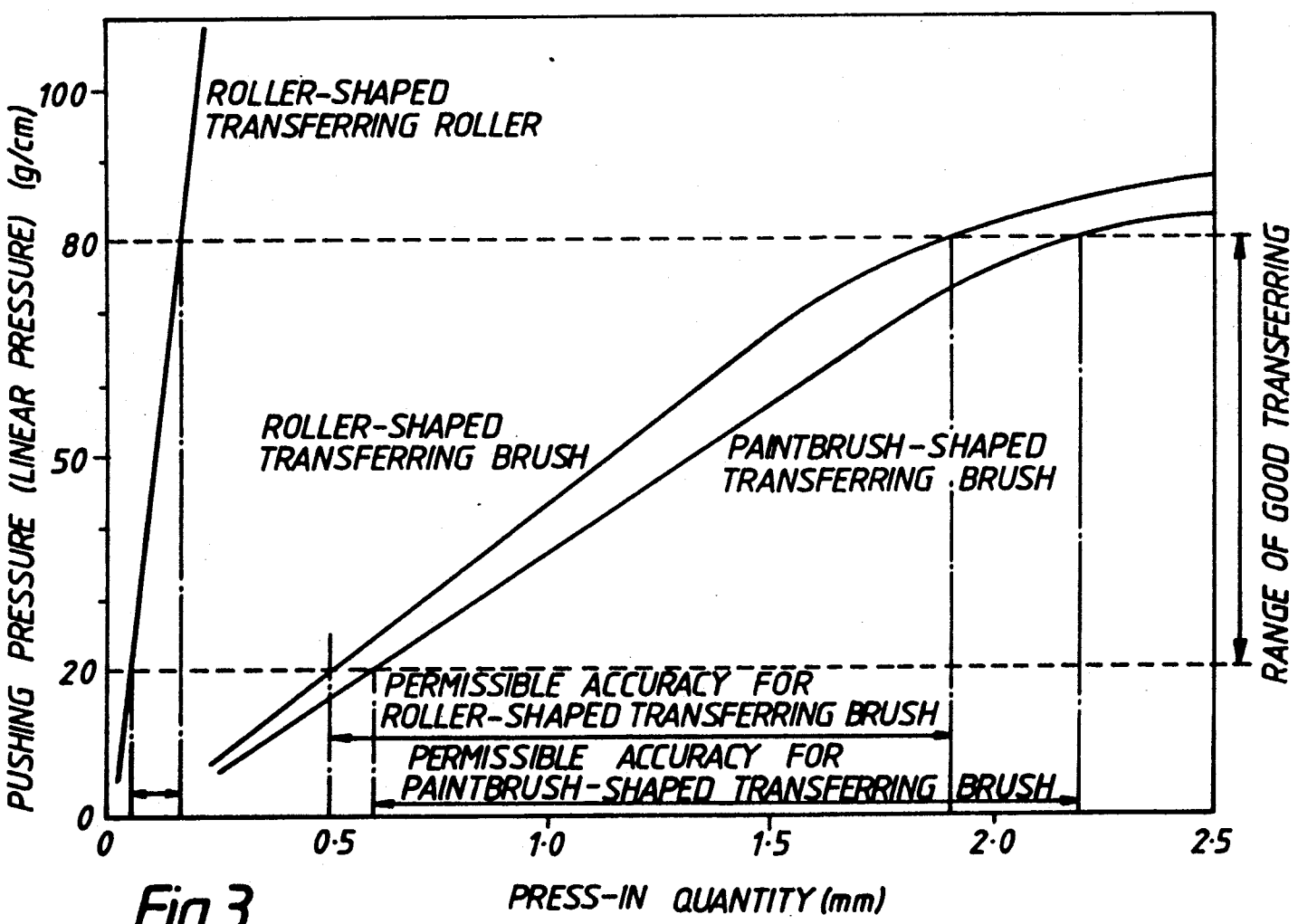
FIG. 3 is a graph showing the relationships between the amount of press-in of the roller-shaped transferring roller, roller-shaped transferring brush and a paint-brush-shaped transferring brush against a photosensitive drum and the pushing pressure.

FIG. 3 shows the relationships between the amounts of press-in of the roller-shaped transferring roller and roller-shaped transferring brush against a photosensitive drum and the pushing pressure (linear pressure) determined using a spring balance. The pressure imposed on the roller-shaped transferring roller and on the roller-shaped transferring brush was varied and tests on actual transfer of images were conducted. The results were that with a linear pressure of 20 [g/cm] or less, transfer drop-out portions occurred, probably because the mechanical contact was insufficient. While with pressure of 80 [g/cm] or more center drop-out images as described above occurred. A consideration of these test results together with results of FIG. 3 showed that the proper press-in quantity for a roller-shaped transferring roller is 0.1±0.05 [mm] at most whereas for a roller-shaped transferring brush it is 1.2±0.7 [mm], which is in effect a 10 times broadening for the mechanical precision, i.e., for the part precision and the positioning precision in assembly. It has thus been made possible to resolve the problem of set-up precision which has constituted a considerable obstacle to the practical use of transferring rollers for which rubber rollers are employed.

The same tests were also conducted on a paintbrush-shaped transferring brush. More specifically, fibers with a thickness of 8 [denier] and an electrical resistance of $10^6$ [Ω·cm] were planted at a density of 1,000 [fibers/mm] to produce a plate-shaped brush **15*b* with a protrusion length of 10 [mm]. The relation between the applied pressure and the press-in quantity when the brush was brought into contact with photosensitive drum 1 at a contact angle of 20 [degrees] at a point that, going in the direction of rotation of the photosensitive drum, was 20 [degrees] downstream of a vertical line passing through the center of photosensitive drum 1 and the brush was pivoted about the shaft 15*d*** shown in FIG. 2A to change the amount of press-in was determined. The result of this is shown in FIG. 3.

It is seen from the results of FIG. 3 that with a press-in quantity in the range 1.4±0.8 [mm] the applied pressure becomes 20–80 [g/cm] and good transfer can be effected. Taking the brush tip to pivot shaft center distance to be 13 [mm], if ±0.8 [mm] is expressed as an angle, the value is roughly 7 [degrees], from which one sees that there is no demand for mechanical precision.

Figure 4:
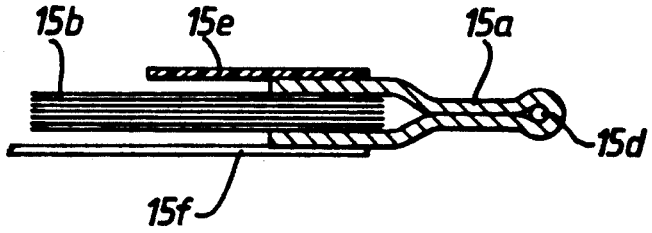
FIG. 4 is a cross sectional view showing another embodiment of the transferring brush.
Figure 5:
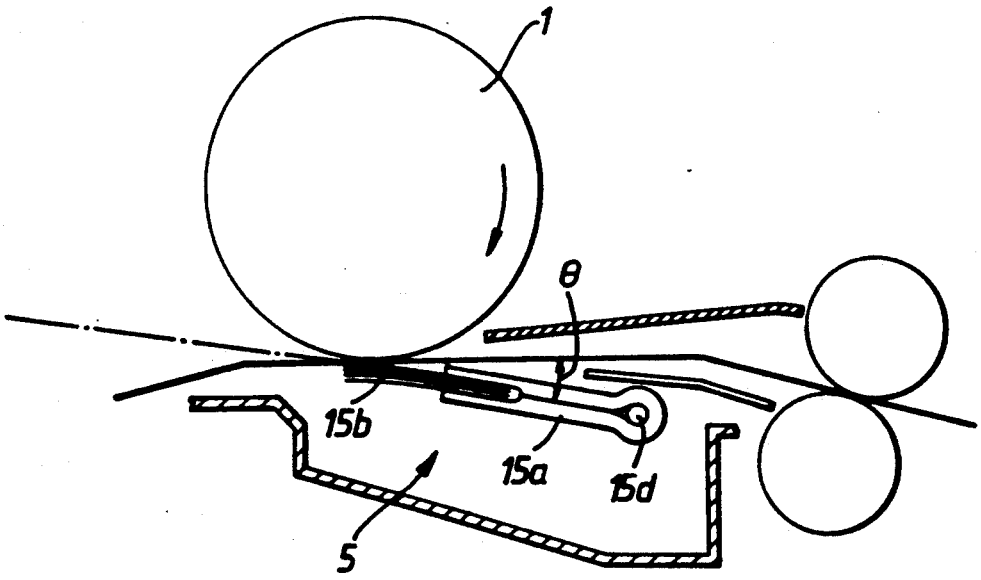
FIG. 5 is a schematic view showing the angle defined between paper and transferring brush contact.

Pivot shaft **15*d* brings transferring brush 15*b* into contact with photosensitive drum 1 at a point that is downstream going in the direction of photosentive drum rotation. Support member 15*a* (made of aluminum) of transferring brush 15*b* also serves as a transfer guide and when transfer is effected onto thin paper, even if the leading edge of the paper sags, the paper is guided to the transfer region (the nip defined by photosensitive drum 1 and brush 15*b*) by this support member 15*a*. However, a transfer bias voltage is applied to support member 15*a* and if the paper comes into contact with support member 15*a* or transferring brush 15*b* root portion before the paper comes into close contact with photosensitive drum 1, the paper becomes charged and part of a toner image is transferred onto the paper before the paper reaches the transfer region, resulting in image faults, such as double images. All that is needed to counter such a phenomenon is for an insulating flexible plate (sheet) 15*e* about 0.05 to 0.3 [mm] thick to be stuck to the paper entry side of support member 15*a* as shown in FIG. 4 or be crimped together with the brush fibers. However, if the paper first comes strongly into contact with photosensitive drum 1 or first comes strongly into contact with insulating flexible plate 15*e* transfer blurring or paper jams can occur. All that is needed to prevent this is to make to the brush contact angle $\theta$ relative to the paper entry 5 to 30 [degrees], as shown in FIG. 5**.

Since the fibers are deformed if the brush is used for a long time, a good measure is to provide back-up with flexible plate **15*f*** that is slightly stiffer than the brush.

Referring to FIG. 1, paper supply unit 18 for accomodating and supplying paper is arranged below photosensitive drum 1. Above paper supply unit 18, paper feed roller 19 is arranged to feed out the paper onto transport path 14. The paper fed from paper supply unit 18 is timed for entering the transferring section by aligning roller pair 29. At the end of transport path 14, fixer 20 is arranged to fix the toner image which has been transferred onto the paper.

When toner is transferred onto the paper in transfer device 5, there is not transfer of 100 [%] of the toner and residual toner is present on photosensitive drum 1. Generally, in electronic photocopying apparatus, this residual toner is removed by a cleaning device. In this embodiment, however, developing/cleaning device 4 operates to remove the residual toner as a cleaning device. The residual toner is dispersed by the toner memory erasure element so that no pattern is discernible. As shown in FIG. 1, memory erasure brush 6, made of a conductive material, is used as a memory erasure element. A −600 to +600 [V] DC bias voltage or a bias voltage in which AC with an effective value of 300–600 [V] and a frequency of 200 to 2,000 [Hz] is superimposed on −200 to +200 [V] DC is applied to brush 6.

The residual toner, throughly dispersed by memory erasure brush 6, has its polarity brought to the normal (−) polarity when photosensitive drum 1 is charged by main charger 2 and is recovered by developing/cleaning device 4.

Transferring device 5, which is the principal part of the present invention will now be described in further detail. In order to transfer the toner image on photosensitive drum 1, a bias voltage of −600 to −1600 [V] is applied to transferring brush **15*b* via support member 15*a*. By this applying of the bias voltage, the rear surface of the paper is charged to (+) in the nip defined by transferring brush 15*b* and photosensitive drum 1 and toner on photosensitive drum 1** with (−) polarity is transferred electrostatically onto the paper.

Transferring brush 15b is soiled by the toner as it is used and the rear surface of paper may also be soiled. In order to effectively prevent this, in the interval between sheets of paper during continuous printing ('the paper interval'), −100 to −800 [V] bias voltage, which is the opposite polarity to the basic bias voltage, is applied to transferring brush 15b. By this means, toner adhesion to transferring brush 15b is prevented, and the accumulated toner is blown off from transferring brush 15b. Further, transferring brush 15b is separated from photosensitive drum 1 by rotating it around pivot shaft 15d. Thanks to measures such as these, transferring brush 15b maintains good transfer performance without the rear surface soiling of paper for more than 100,000 printed copies. This method of transfer shows greater transfer efficiency than corona transfer, especially in very humid environments in which the humidity was 70 [%] or more.

Since, as noted above, there is a broad mechanical precision tolerance range for the transferring device using the transfer elements of flexible material and the brush that are employed in the present invention, the precision of the contact mechanism presents no problem in the execution of separation actions. However, when it is attempted to perform these separation actions for a transferring roller, strict positional precision is required and positional precision becomes lost and transfer dropouts and transfer faults occur when the separation action is repeated. It is, therefore, difficult to effect separation action with a transferring roller. Further, in the case of a transferring roller, it is necessary to have a drive mechanism for rotating the roller in order to effect forwarding of paper, and the structure that includes a drive mechanism for effecting separation actions is complex. In contrast when use is made of a plate-shaped element (brush, rubber, etc.), separation actions can be effected simply by means of a solenoid or cam, etc.

Detailed examinations concerning transfer bias revealed the following inexplicable phenomenon. Immediately after the image forming apparatus starts image formation and transfer bias power source 21 is turned on and immediately after bias power source 21 is turned off at the end of image formation, toner which has accumulated on transferring brush 15b is blown onto photosensitive drum 1 in strip form and this causes soiling of memory erasure brush 6. Further, at worst, it fails to be cleaned in developing/cleaning device 4 and stripe-shaped image faults are produced on photosensitive drum 1. An investigation into the cause of this revealed that it becomes marked when the 90 [%] rise time $t_{on}$ when the bias voltage is applied and the fall time $t_{off}$ when the bias is removed in 20 [msec] or less. One anticipates that this is a phenomenon in which toner of the same polarity is sprayed out because of a counter electromotive force due to the electrical resistance and electrostatic capacity of transferring brush 15b. The problem is, therefore, solved when the bias power supply voltage rise time $t_{on}$ and the fall time $t_{off}$ are 20 [msec] or less and preferably 100 [msec] or less.

There is also provided a falling toner receptacle 23 in transferring device 5, to catch toner falling from the transferring elements.

With transferring device 5 using conductive brush 15b possessing the elasticity described above, the structure is such that the equipment cost is low, little ozone is generated and soiling is easily prevented. This not only achives good transferring performance in a wide range of environmental conditions for long periods but also the load on the cleaning device (the developing/cleaning device in the case of this embodiment) is reduced by removing paper dust, etc. at the same time. Further, whereas with a roller transferring device, there are strict requirements for mechanical precision and this problem has constituted an obstacle to practical use. With a transferring device, as described, the tolerance range for mechanical precision is broad. Thus, there are no transfer faults either with thick or thin paper and since all that is needed is a simple structure, a great reduction of cost can be achieved.

It is noted that although the description has focused on a transferring device using a brush, the present invention is not limited to this. As well as a brush, a plate-shaped resilient transferring member 15c can also be used and performance similar to that when a brush is used can be achieved by adjusting the elastic modulus, plate thickness, protrusion length, press-in quantity and contact angle in the same way as for a brush.

Further, although the embodiment has been described with reference to a process using a developing/cleaning device, the same effects are also had in a process using a cleaning device.

The mechanism for moving the brush or elastic plate member away from the photosensitive drum will be described.

Figure 6A:
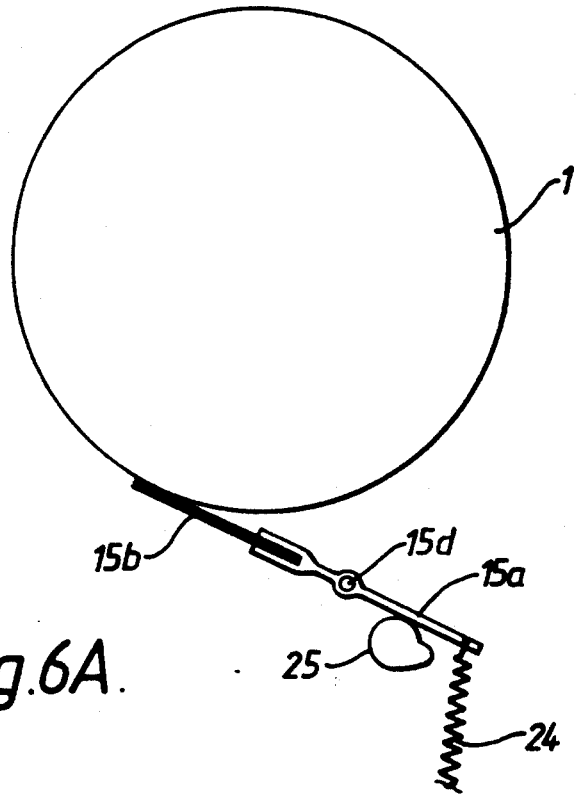
FIGS. 6A and 6B are schematic views showing the contact/separation mechanism when the transferring brush and the contact/separation mechanism are installed on the machine side.
Figure 6B:
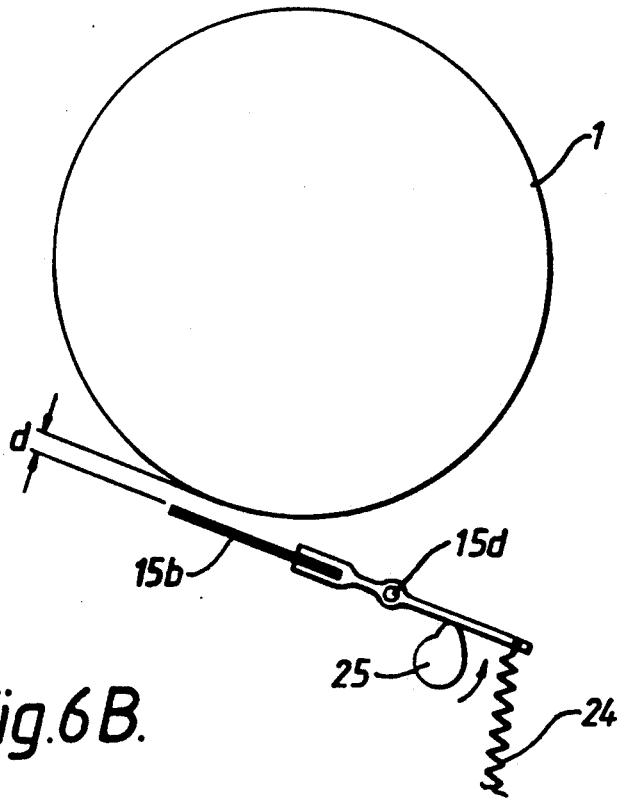

In the embodiment shown in FIG. 1, transferring brush 15b is mounted in apparatus housing H and the transferring brush pressing mechanism too is provided on the housing H side. FIGS. 6A and 6B show an example of transferring device 15 when the transferring brush and the transferring brush pressing mechanism are disposed on the housing side. Spring 24 mounted at an end of support member 15a causes transferring brush 15b to be subjected to pressure in a direction causing it to be pushed against photosensitive drum 1, with pivot shaft 15d as a pivot point. If, for the sake of low transfer pressure setting conditions and because of the considerable weakness of brush 15b, one attempts to set the applied pressure by means of the spring coefficient, it is necessary to make the spring coefficient quite small and after long-term use there arise problems such as the stretching of spring 24. What is done, therefore, is to set the pressure applied on the transferring brush by setting the amount of press-in of brush 15b against photosensitive drum 1 by bringing a portion of brush support member 15a or a member (called the cam contact part below) that is integral with support member 15a into contact with cam 25.

Figure 7A:
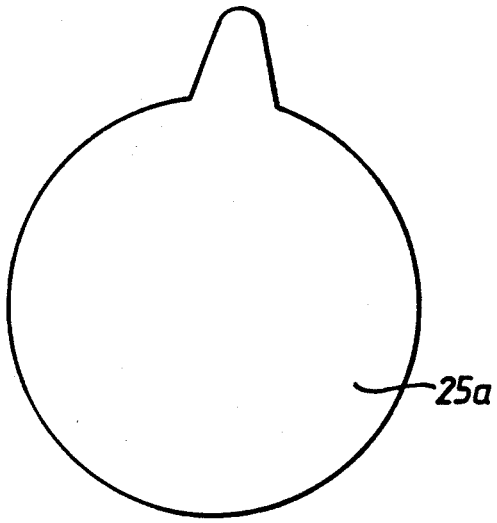
FIGS. 7A to 7C are plan views each showing the shape of a cam that is used contact/separation mechanism.
Figure 7B:
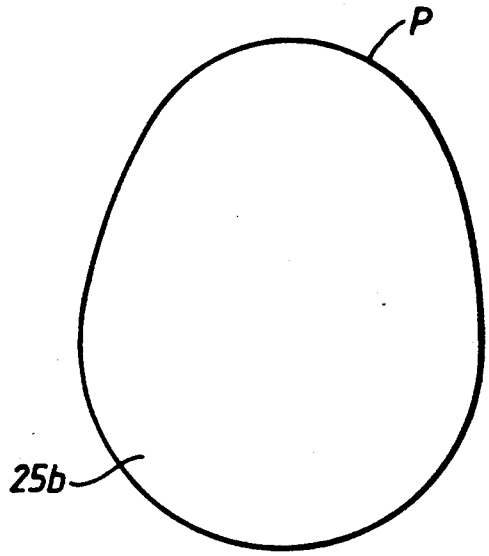
Figure 7C:
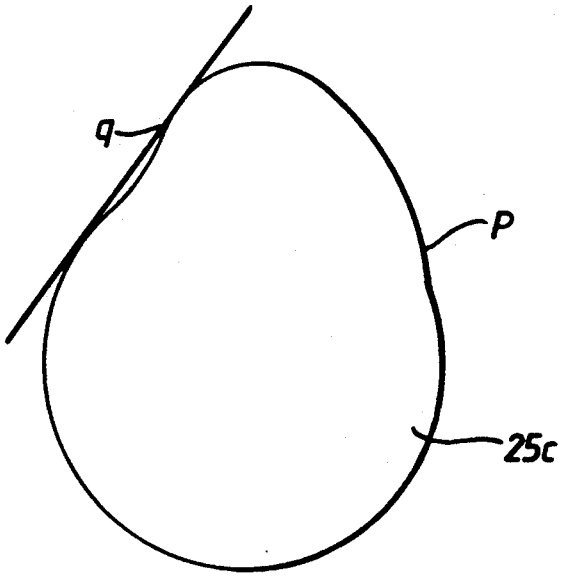

To move transferring brush 15b away from photosensitive drum 1, cam 25 is rotated and hereupon the cam projection portion contacts and pushes up the cam contact portion as shown in FIG. 6B. As a result, transferring brush 15b turns centering on pivot shaft 15d and moves away from photosensitive drum 1. In this case, if the separation distance d is too small, toner adhering to photosensitive drum 1 jumps over onto brush 15b and causes fouling of the brush, and it is, therefore, necessary to make the separation distance d 1 [mm] or more. If the bringing together and separation actions are performed quickly, toner adhering to the brush is dispersed in the interior of the apparatus, so there is no fouling of the apparatus interior. When separation is performed at paper intervals, synchronization stagger can be caused by sudden changes of the torque applied on photosensitive drum 1. Contacting and separation of transferring brush 15b must therefore be done smoothly. In particular, the problems described above are very marked if the projection portion of cam 25 is pointed as in cam 25a shown in FIG. 7A, and the curve of the projection portion must therefore be smooth as in cam 25b shown in FIG. 7B, or imperfectly ovate as in FIG. 7C. Further, since the problems can easily occur when the brush comes into contact with the photosensitive drum, preferably curve p when the brush is contacted is smooth.

Figure 8A:
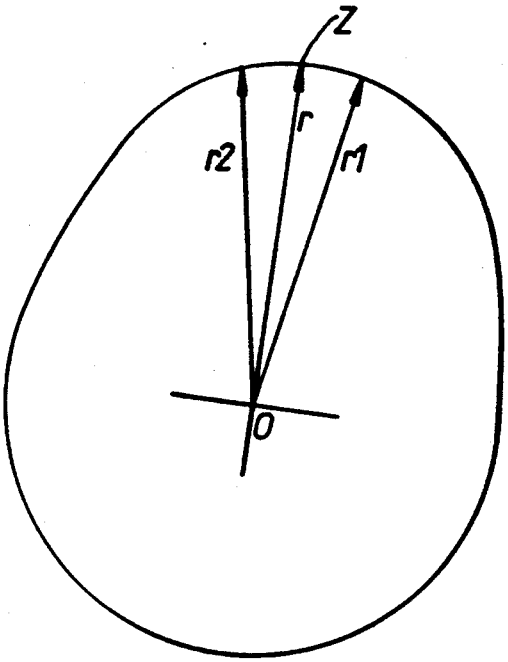
FIGS. 8A and 8B are schematic views showing parameters for the required cam shape.
Figure 8B:
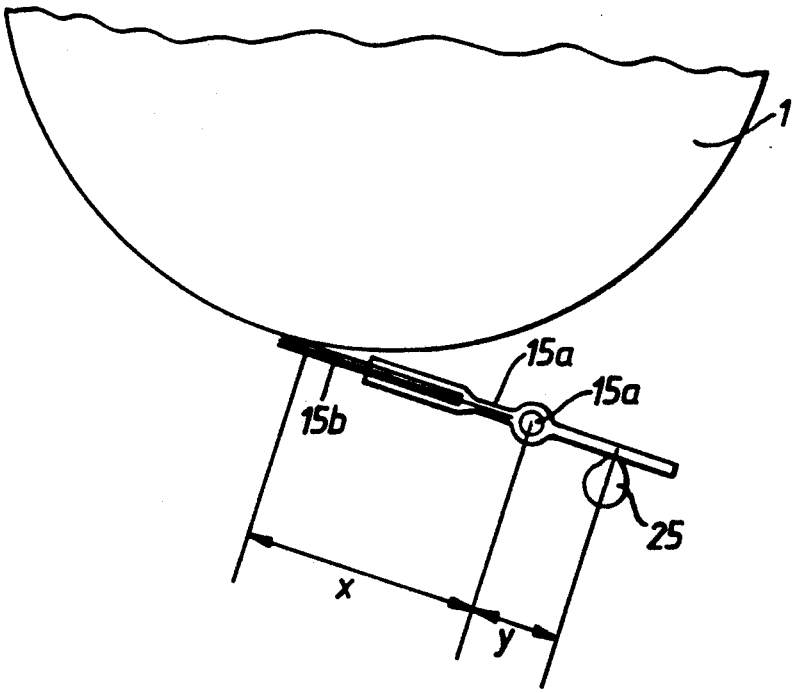

Further, if the cam in one like 25a, a slight error in the rotation angle caused by gear backlash or an error in mounting precision, etc. is transformed to a large difference under transfer pressure. Very approximately these errors are ±5° or less in respect to the direction of cam rotation. In order to maintain a brush press-in precision of ±0.8 [mm], even at the maximum error of 5°, the inequalities (1) and (2) below must be satisfied in the arrangement of the transferring member shown in FIG. 8A and FIG. 8B.

$$r-r_1 \leqq 0.8 \times y/x \quad (1)$$

$$r-r_2 \leqq 0.8 \times y/x \quad (2)$$

r: a radius [mm] of cam at portion z that contacts the brush contact portion when the brush is in contact.

$r_1$: a radius [mm] of cam at the portion that is 5 [degrees] upstream in the direction of rotation from z.

$r_2$: a radius [mm] of cam at the portion that is 5 [degrees] downstream in the direction of rotation from z.

x: distance [mm] from brush contact point to brush pivot shaft 15d.

y: distance [mm] from cam contact point to brush pivot shaft 15d.

With a cam that satisfies the inequalities (1) and (2), the brush is brought smoothly into contact with the photosensitive drum and no drop-off of toner from the brush occurs.

If a transferring brush and other members that satisfy the suitable conditions described above are used, since the error tolerance for member press-in against the photosensitive drum is approximately 0.4 [mm] or more. Accordingly, if a member satisfies the formulas (3) and (4) below it may suitably be used as a cam of the contact and separation mechanism in the transferring device of the present invention.

$$r-r_1 \leqq 0.4 \times y/x \quad (3)$$

$$r-r_2 \leqq 0.4 \times y/x \quad (4)$$

In the formulas (3) and (4) above, the smaller the difference between r and $r_1$, $r_2$ the better; but for separation action there are situations, such as, e.g. when a jam occurs, in which it is required to instantaneously move the brush away from the photosensitive drum. Therefore, it is preferable that there be a comparatively sharp curve that satisfies the formulas (3) and (4) as in cam 25c of FIG. 7C.

If the cam is rotated at a constant rotational speed during the contact and separations actions, $r-r_1$, the above formulas determines the speed of coming into contact with photosensitive drum 1, and $r-r_2$ determines the speed of separation of transferring brush 15b from photosensitive drum 1.

Therefore, the separation speed can be made faster than the contacting speed by having $r-r_1 > r-r_2$.

Although the description above is given with reference to the case where cam 25 contacts brush support member 15a on the force point side (i.e., the spring side) of pivot point 15d, it is the same as if on the action point side (i.e., the photosensitive drum contact point side). In this case, however, since the cam is above the brush, it is not possible to establish a paper path. If the cam is located at the front the cam hinders process unit mounting and dismounting. The cam is therefore located at the rear.

Figure 9:
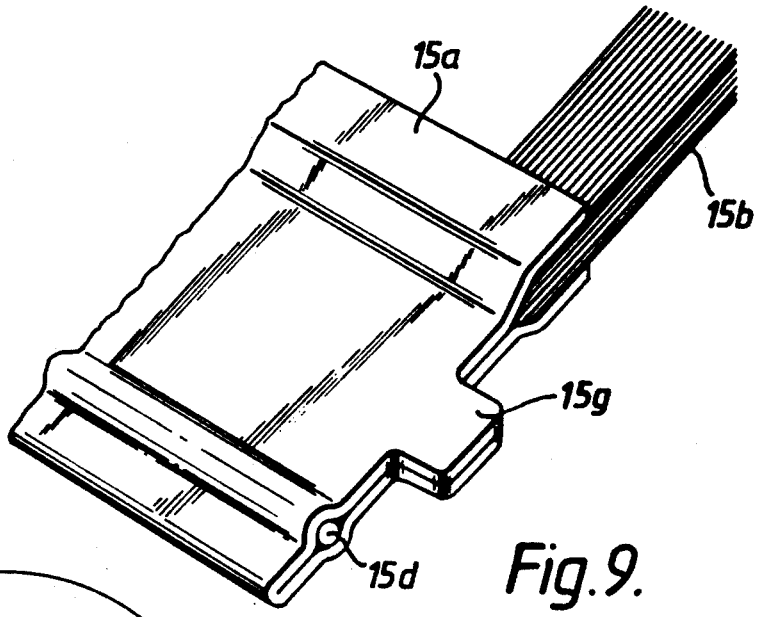
FIG. 9 is a perspective view showing a brush support member that has a contact member.

At the time of making contact, the rear end of the is positioned by contact members 15g as shown in FIG. 9 which are provided on opposite sides of the brush and constitute parts of brush support member 15b, or are integral with brush support member 15b coming into contact with cam 25. The front end of the brush is positioned by contact member 15g coming into contact with portion of the apparatus or process unit. When the brush is moved away, the contact member 15g at the rear end is in contact with cam 26 while the front end may not be in contact with anything, or may be positioned by being brought into contact with a part of the apparatus.

The description above was given with reference to the case where the transferring device is installed on the apparatus side, and in this case the transferring device's replacement cycle is made longer than the process unit's replacement cycle. In the embodiment of FIG. 1, the process unit's replacement cycle is 5,000 [sheets], whereas the replacement cycle of the transferring device (brush) is set at 20,000 [sheets]. When the transferring brush is used for such a long time, deterioration of the transfer functions occurs because of fouling of the brush and fouling of the rear surfaces of paper, etc. and so it becomes necessary to clean the brush.

Figure 10A:
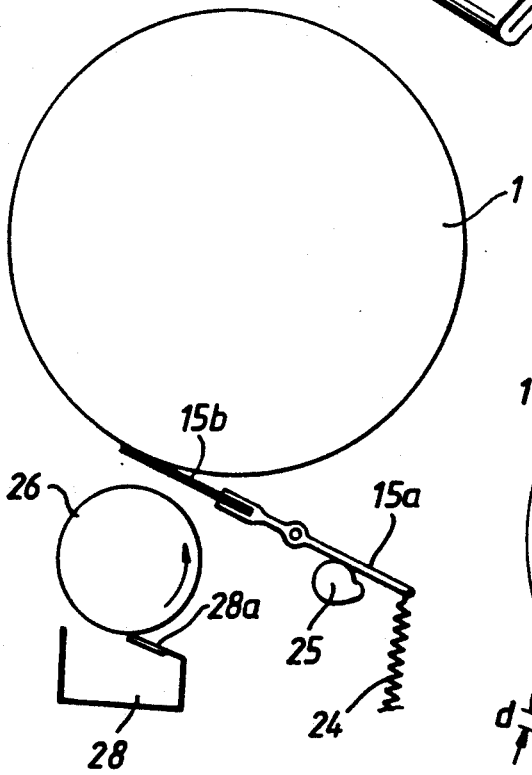
FIGS. 10A and 10B are schematic views showing one example of a brush cleaning unit.
Figure 10B:
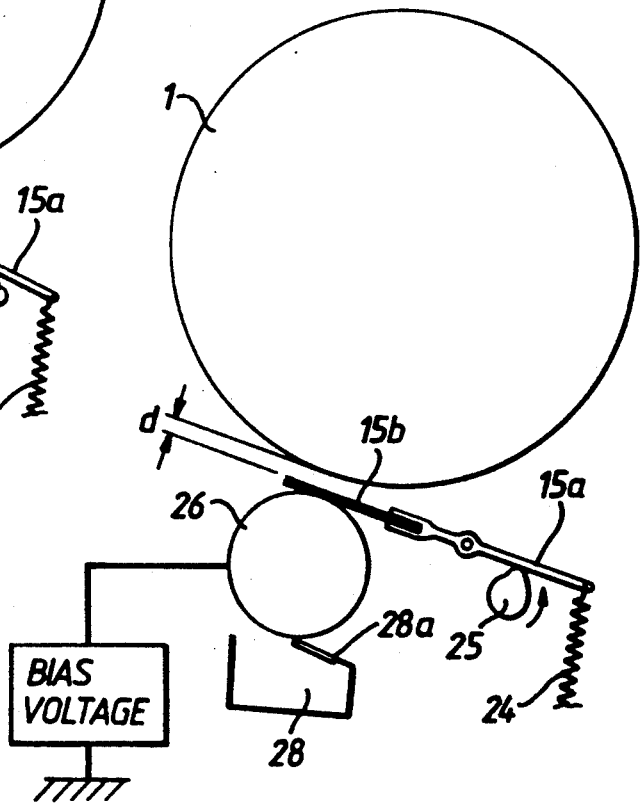

By way of procedure for cleaning the brush there is a method in which a bias voltage (about −100 to 500 [V]) that is the reverse of the transfer bias voltage, is applied to transferring brush 15b in paper intervals and toner is blown off in paper intervals or at times of printing start operations. If it is wished to effect still more cleaning, note FIGS. 10A and 10B. When transferring brush 15b that had been in contact with photosensitive drum 1 (FIG. 10A) has been moved away from the photosensitive drum 1 (FIG. 10B), the transfer bias voltage is made 0 [V], contact with a cleaning roller 26 on which a bias voltage is applied. By this means, the toner moves from brush 15b onto cleaning roller 26 and cleaning roller 26 is cleaned in turn by blade 28a. The toner is recovered in waste toner receptacle 28. Cleaning roller 26 is made of metal, conductive resin or a similar conductive roller with good surface characteristics. As the amount of toner recovered in this process is very small, waste toner receptacle 28 has the same life as the machine and is not replaced.

Since it thus becomes necessary to have a cleaning mechanism when the transferring brush is used for a long time, the apparatus becomes larger and more costly. A possible system therefor is one in which the brush is installed on the process unit side and transferring device 5 is replaced each time the process unit is replaced. With this arrangement there is no need for a cleaning unit since it is satisfactory if the life of the brush is 5,000 [sheets], the same as the process unit's life.

There now follows a description of an example of the case where the transferring device is installed on the process unit side.

Figure 11:
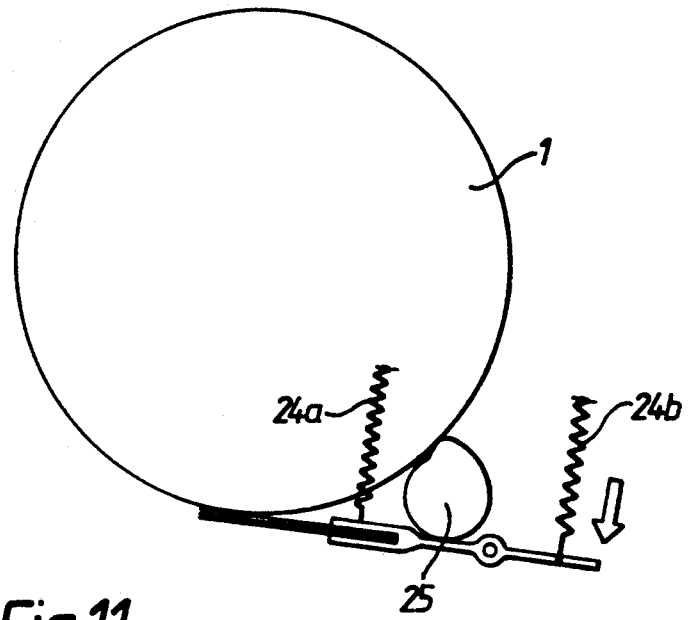
FIG. 11 is a schematic view showing one example of a contact/separation mechanism when the transferring brush and the contact/separation mechanism are installed on the process unit side.

FIG. 11 shows an embodiment of a process unit including a transferring brush. In the drawings, reference numeral 24a denotes a spring where spring contraction is used to impose pressure on the brush and 24b denotes a spring with which elongation is used to cause the brush to be pressed against photosensitive drum 1. It is satisfactory if one or the other is provided, and the other end of the brush to the spring is supported by the process unit.

In the case described above in which the transferring device is installed on the apparatus side, a cam is installed in approximately the center, going in the direction of length of the brush support member, since the cam is underneath the transferring device. However, when the transferring brush and separation mechanism are installed in the process unit, because of the shape of the process unit the cam comes to be on the process unit side (i.e., the upper side), and so, in view of the fact that paper is fed in between the brush and the photosensitive drum, the cam is located at the brush end. Therefore, in the example shown in FIG. 11, the structure is one in which cam 25 is installed at the rear end, where it is easy to effect cam drive, contact member 15g contacts with cam 25 and the front end is caused to contact contact member 15g by a contact control member (not shown) which is formed integrally with (or mounted on) the process unit. Thus, when the transferring brush is in contact with photosensitive drum 1, positioning is effected by contact member 15g being in contact with the contact control member at the front end and in contact with the cam at the rear end. At times of separation nothing contacts the front-end contact member 15g. Only the rear-end cam projection portion is contacted, and the transferring brush is held away from photosensitive drum 1.

It is, of course, desirable that the cam have the same shape as in the case where the transferring device is installed on the apparatus side.

With the construction described above, high positioning precision is easily achieved for the brush contact position, since the brush and cam are all located on the process unit side and the precision of the brush contact is determined solely by the precision on the process unit side. In the present invention, since the tolerance range for position precision is broad, the cam which determines the brush's contact position can be located on the apparatus side. This makes it possible to reduce the cost of the process unit by an amount corresponding to the cam structure.

Figure 12:
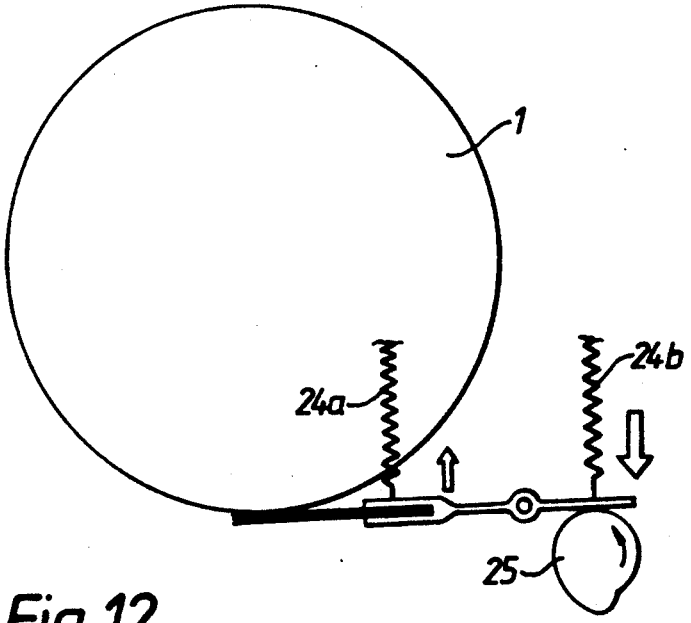
FIG. 12 is a schematic view showing one example of a contact/separation mechanism when the brush is installed in the process unit and the contact/separation mechanism is installed on the machine side.

FIG. 12 shows an embodiment in the case where the transferring brush is located in the process unit and the separation mechanism is located at the apparatus side. It is seen that, in contrast to the example shown in FIG. 11, cam 25 constituting the separation mechanism is installed underneath the transferring brush.

The above was a description relating to a contact and separation mechanism in a state in which the process unit is mounted in the machine. In the description above, the spring force acts in a direction to effect contact with photosensitive drum 1. The arrangement is made such that the spring's elasticity acts in the direction to apply pressure since there is higher contact flexibility when the brush is brought into contact with photosensitive drum 1 by a spring. However, the following problems arise if the transferring brush is in contact with photosensitive drum 1 when printing is not being effected.

(1) The transferring brush acquires a set and the applied pressure becomes insufficient.

(2) In cases where the transferring brush is installed in the process unit, the transferring brush acquires a set in the period between shipment and use of the image forming apparatus.

Case (1) is a problem even inside the apparatus, but the problem can be resolved by establishing a sequence for moving the transferring brush away at times when no printing operation is being done. If the arrangement is made such that the transferring brush is withdrawn from photosensitive drum 1 at times of printing end operations or when jams occur, the transferring brush does not contact photosensitive drum 1 during periods when no printing operation is being done and so does not acquire a set.

Even for case (2) in which the transferring brush is installed in the process unit, the measure for (1) results in there being no problem when the process unit is mounted in the machine. However, the period between shipment and use of the process unit can possibly be several weeks to as much as one year, and the transferring brush acquires a set if the transferring brush is in contact with photosensitive drum 1 throughout this period.

Figure 13A:
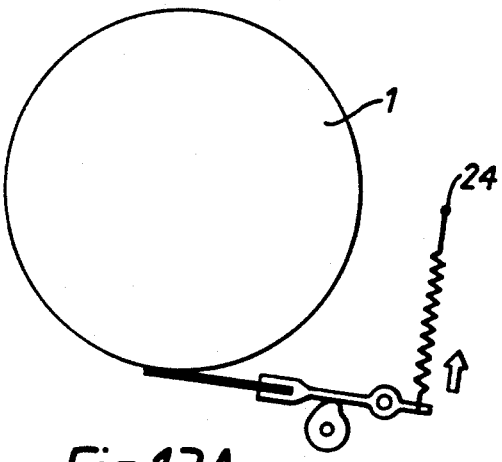
FIGS. 13A to 13C are schematic views showing one example of a contact/separation mechanism by which the transferring brush is moved away when the process unit is removed from the machine.
Figure 13B:
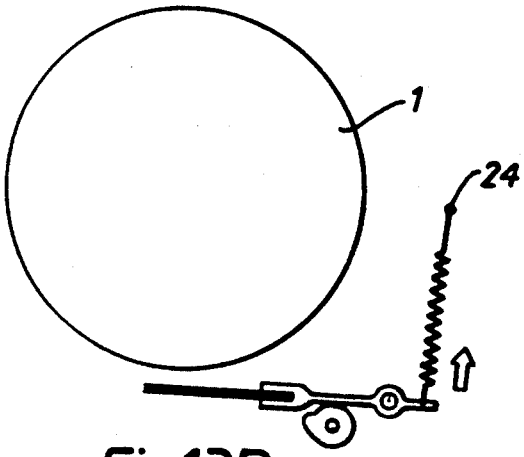

By way of countermeasure, the arrangement can be made such that the force of a spring member acts in a direction to effect separation from photosensitive drum 1 as shown in FIG. 13B. When, the unit having been mounted in the machine, contact is necessary (i.e., when transfer is to be effected), brush contact can be brought about by a contact mechanism such as a cam, etc. In other words, in the example of FIG. 12 positioning is effected by pressing such that the force of the spring acts in the direction to bring about brush contact with photosensitive drum 1 and the cam imposes on the brush contact portion a force opposite the contact direction. However, if the spring is caused to act in the direction for causing separation and a cam pushes in the direction for effecting contact as in FIG. 13A, it is possible to keep the brush separated from photosensitive drum 1 during the time when the process unit detached (shown in FIGS. 13A and 13B).

Figure 13C:
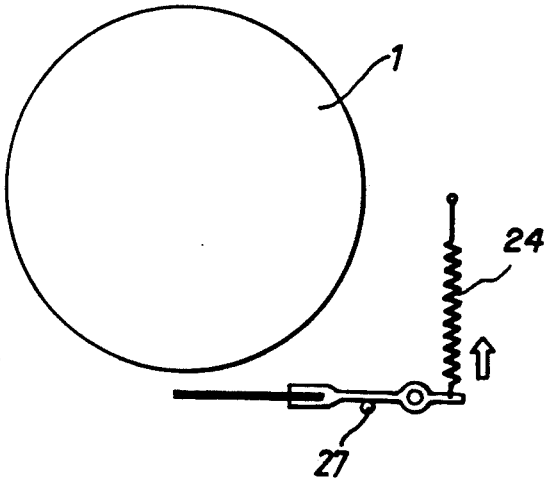

If the cams of FIGS. 13A and 13B are located on the process unit side, positioning of the transferring brush when the process unit is removed from the apparatus can be effected through contact with the cam (FIG. 13B). But if the cam constituting the contact and separation mechanism is located on the apparatus side, it is necessary to have a member for preventing the transferring brush from turning too much. In the example shown in FIG. 13C. brush turning restriction member 27 prevents the brush from turning beyond it. This turning restriction member 27 is formed integrally with the process unit.

A description taking as an example a construction in which a cam is used as a contact and separation mechanism in the transferring device was given above with reference to the case where the transferring device is installed on the apparatus side, the case where the transferring device is installed in the process unit and the case where the transferring device is installed in the process unit and the cam constituting the contact and separation mechanism is installed on the apparatus side. Apart from these arrangements, another possible arrangement is to make the structure one in which the brush support member and pivot shaft are integral and to effect brush contact and separation are by turning the shaft by a stepping motor or to use a solenoid to effect contact and separation.

The brush bias, contacts and separation action will be described.

There are 4 modes for the transferring brush mode as described below.

In a mode (1), a normal transfer bias voltage [(+) polarity] is applied to the transferring brush and the brush is caused to contact photosensitive drum 1.

In a mode (2), a bias voltage that is of opposite polarity [(−) polarity] to the normal polarity is applied to the transferring brush and the transferring brush is caused to contact with photosensitive drum 1.

In a mode (3), no bias voltage is applied to the transferring brush and the transferring brush is caused to contact with photosensitive drum 1.

In a mode (4), no bias voltage is applied to the transferring brush and the transferring brush is moved away from photosensitive drum 1.

The mode (1) is used when transfer is effected. The mode (2) is used when it is required that toner adhering to the transferring brush be blown onto photosensitive drum 1.

Figure 14:
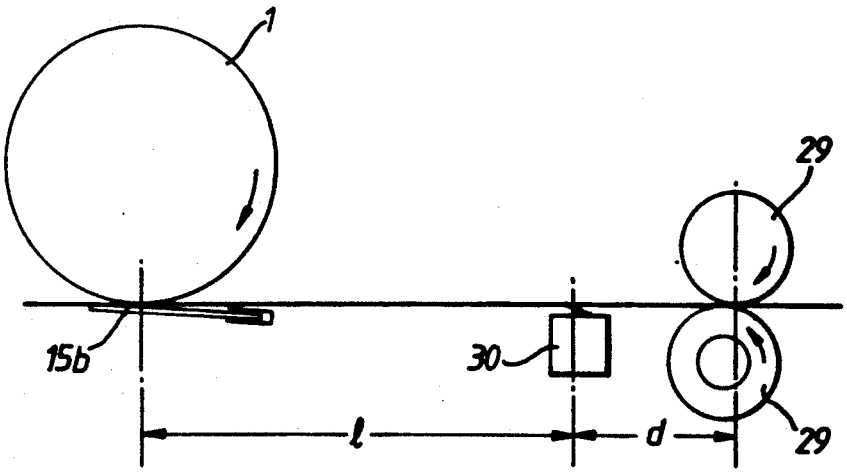
FIG. 14 is a schematic view showing the arrangement of a jam detection means between an aligning roller pair and a transferring section.

The mode (4) is used when the requirement is that toner adhering to photosensitive drum 1 does not adhere to the transferring brush. If a paper jam occurs or if toner that has not been transferred is present in the development and transfer section of photosensitive drum 1, then, of necessity, the mode (4) must be used. If the modes (2) and (3) were used, physically quite an amount of toner would adhere to the transferring brush, since a large amount of toner remains on photosensitive drum 1, and there would be problems of the paper rear surface fouling, etc. However, for dealing with a jam, even if the mode (4) is used, if the image region has reached the transferring position at the time the apparatus stops because of jam detection, the transferring brush on which a (+) bias voltage is applied strongly attracts toner, resulting in considerable brush fouling. Therefore, as shown in FIG. 14, it is necessary to have jam detection sensor 30 between the paper supply and transfer sections. Further, designating the length of the paper transport path from jam detection sensor 30 to the transfer section as l [mm], the paper transport speed as v [mm/sec] and the jam detection time (from the design time when the leading edge of paper should reach the sensor to the time when it is judged whether or not a jam has occurred) as $t_1$ [sec], the following formula must be satisfied.

$$t_1 < l/v \tag{3}$$

In the jam recovery operation after jammed paper has been removed, residual toner on photosensitive drum 1 after the transferring operation can be recovered in developing/cleaning device 4, without transferring brush **15*b* being fouled, by turning main charger 2 on and applying the developing bias voltage while transferring brush 15*b* in still in the withdrawn position. If the bias voltage being applied to memory erasure brush 6 is turned off (floated) at this time, toner image on photosensitive drum 1 passes by with hardly any adhesion to memory erasure brush 6 and so there is no fouling of memory erasure brush 6 by toner and no flying about or drop-off of toner. Preferably, a separation device is made available for memory erasure brush 6, as in the transferring device. Brush 6 is moved away from photosensitive drum 1 during the jam recovery operation, since this reduces any more fouling of brush 6**.

In the jam recovery operation, it is preferable to hold the transferring brush separated from the image carrier for at least the time $t_2$ [seconds] of the equation (4) below following the start of rotation of the image carrier.

$$t_2 = x/v \tag{4}$$

x: distance [mm] from development position to transfer position.

However, if the image carrier is in the form of a drum, $t_2$ is given by the following equation (5).

$$t_2 = \theta \times r/v \tag{5}$$

$\theta$: process angle [rad] between development position and transfer position.

r: drum radius [mm]

Measures such as above make it possible to prevent fouling of the transferring brush when a paper jam occurs in the paper supply section. However, if a jam occurs after transfer has started, as is the case when paper wrapped on the photosensitive drum jams, there is toner adhering to the drum in the vicinity of the image transferring region after the paper has been removed. If the transferring brush touches this area, it becomes fouled. Therefore, if a jam occurs, the sequence employed is to immediately turn off the brush bias voltage and to end the contact with the photosensitive drum 1. This makes it possible to prevent fouling of the transferring brush. Further, if the brush contact is terminated when a jam occurs, the jammed paper can be taken out easily. For the jam recovery operation in this case too, it is simply necessary to follow the same procedure as described above for paper supply jams.

The sequences in the printing start operation (start of photosensitive drum 1 rotation to first printing) and the printing end operation (completion of final printing to stopping of photosensitive drum 1) will be described.

In the embodiment shown in FIG. 1, the printing start operation is effected by the following sequence. First, in a no-printing state (when the apparatus is stopped), transferring brush **15*b* of transferring device 5 is moved away from photosensitive drum 1. A one-component contact developing device is used as developing/cleaning device 4 in the embodiment shown in FIG. 1. However, although this developing device is excellent in toner cleaning capability, resolution and other aspects of image quality, there is a considerable problem when a contact type transferring mechanism is employed. This arises because of the development characteristics of this developing device. In general, there is hardly any toner development with a developing bias of 0 [V] when two-component developing or non-contact developing is used. There is considerable adhesion of toner to photosensitive drum 1** (0 [V] development) in a one-component contact developing device.

For example, in the printing start operation of an ordinary printer, when the photosensitive drum is rotated, charging is simultaneously activated, developing bias voltage is not applied until the region in which a charge has been imposed on the photosensitive drum reaches a developing device. The developing bias voltage is applied to the developing device after the charged region reaches the developing device. This routine prevents unwanted adhesion of toner to the photosensitive drum. However, with one-component contact developing device, a toner is adhered to this section too. When this toner enters the transfer nip a mechanical adhesion force causes adhesion of quite a large amount of toner to the transferring brush, even if a reverse polarity (+) bias voltage is applied to the transferring brush. Methods devised for preventing this phenomenon include applying a (+) bias voltage to the developing roller in the developing device and stopping rotation of the developing roller. However, with all these methods when the developing roller starts to rotate toner that was in the nip still adheres to photosensitive drum 1 and fouls the transferring brush. Although the amount of toner is small (corresponding to the development nip width), if a transferring roller is used, periodic rear surface fouling by the transferring roller occurs a few papers after the start of printing.

If a brush roller is used as the transferring device, periodic fouling becomes more marked than with a flexible roller. It becomes even more marked in transfer using a fixed member (brush) as in this embodiment. However, gradual accumulation of toner on the fixed member eventually results in a decline in transfer capability and rear surface fouling. Therefore, fouling of the transferring device does not occur if it is kept withdrawn until the above described development toner passes the transfer region.

Since moving the transferring brush away when the apparatus is stopped prevents the transferring brush acquiring a set not just in cases when a one-component contact developing device is employed, it is effective when other developing devices are used too.

In the embodiment shown in FIG. 1, after the toner adhering to photosensitive drum 1 has passed transferring brush 15*b*, a −200 [V] bias voltage is applied to transferring brush 15*b*. While this bias voltage is applied, transferring brush 15*b* is brought into contact with photosensitive drum 1. Then, after paper has entered the nip (as from about 1–5 [mm] of the leading edge of the paper), the bias voltage of +800 [V], which is the normal polarity, is applied to transferring brush 15*b*. In the printing end operation immediately before the last paper passes the transfer nip (the inside 1–5 [mm] distance from the trailing edge of the paper), the transfer bias voltage is changed to −200 [V]. Immediately before/immediately after drum rotation is stopped transferring brush 15*b* is moved away from photosensitive drum 1 and, as it is moved away, the bias voltage is turned off (made 0 [V]).

Fouling of the transferring brush and the memory erasure brush can be strongly prevented by applying reverse bias voltage to the developing roller at the start of the photosensitive drum rotation or stopping rotation while brush contact and separation and bias control, as described above, are effected. However with the method in which reverse bias voltage is applied, the cost of the development bias power supply becomes higher. With the method in which rotation of the developing roller is stopped, there are problems such as shortening of the roller's life because of the loads imposed on it. Therefore, when a process as in the embodiment shown in FIG. 1 is employed, measures such as applying reverse bias voltage or stopping the developing roller are not taken, and it does not matter if 0 [V] development is effected. Because, 0 [V] developed toner is recovered in the developing/cleaning device and there are no problems, such as an increase in the amount of toner consumed. However, it is necessary to prevent toner adhesion as much as possible by effecting bias control such that when the 0 [V] developed portion passes the memory erasure brush, the brush bias is brought to a floating state.

Another control system on might think of is one in which mode (2) in which a reverse polarity is applied to the transferring brush is not used but brush contact is effected while a bias of +800 [V] is applied only when paper is present in the transfer nip, and at other times the transferring brush is kept out of contact with photosensitive drum 1. However, in this system transfer on/-off has to be effected by the brush contact/separation mechanical actions and it is more difficult to achieve accurate timing than it is in the system of this embodiment employing bias changeover.

Control in paper intervals will now be described.

In this embodiment, mode (2) is used in paper intervals. That is, the transferring brush is still kept in contact with photosensitive drum 1 and the brush bias voltage is made −200 [V] during paper intervals. This method has the following advantages over the method employing mode (4).

1. Control of transfer timing by the mechanical actions of brush contact/separation is inaccurate.

2. In continuous printing of small-sized sheets of paper, even though there are non-image portions, both ends of the brush are in contact with photosensitive drum 1 for a long time and the transferring brush is liable to be fouled. However, brush fouling can be prevented by applying reverse bias voltage, and blowing out toner during paper intervals.

3. When mode (4) is employed during paper intervals, on entry of the leading edge of paper into the transfer nip, the transferring brush is in a withdrawn position. Therefore, the angle constituting the angle of incidence of the paper on brush support member 15*a* or insulating eleatic plate 15*e* which serves as a guide differs from the angle that obtains when transferring brush 15*b* is in a contacting state. As a result, there are problems such as failure of the leading edge of the paper to come against photosensitive drum 1 correctly and transfer blurring.

Therefore, in size A4 printers and facsimile machines, etc. which hardly do small-sized paper printing, and in which the speed of photosensitive drum 1 rotation is slow, it does not matter if the transfer timing is slightly incorrect. It is possible to employ a system in which the transferring brush is brought into contact with photosensitive drum 1 only at times when paper is present in the transfer nip.

The description now continues with reference to the transfer bias voltage.

When toner with a (−) polarity is employed good transfer can be effected by applying of a transfer bias voltage which is a DC bias of +500 to 1500 [V] or this bias voltage with superimposition of AC with an effective value of 300 to 800 [V] and a frequency of 200 [Hz] to 2 [kHz].

In particular, applying of a bias voltage in which AC is imposed on (+) DC is preferable for the purpose of effecting good, stable transfer even in a very humid environment. However, in continuous printing with longitudinal feed of A4 size paper in a machine in which A3 size paper is usable, a (−) potential which is more or less at photosensitive drum 1 charging potential is maintained for the potential of the portion where the transferring brush contacts photosensitive drum 1 via the paper. However, the portions outside the paper, i.e., the portions where the transferring brush is in direct contact with the photosensitive drum 1 become charged to a (+) polarity. As a result, in continuous printing, photosensitive drum 1 portions on the opposite sides are fatigued and the charging potential after passage through the main charger decreases. Therefore, if printing on A3 size paper is effected after continuous printing with longitudinal feed of A4 size paper, a step difference in the image density occurs, with the density of the portions that are outside the A4 section being higher than that of the inside portion (especially in the case of half-tone). Light removal of charges has no effect on the (+) charging of the photosensitive drum 1 and not much effect is provided even if a charge removal lamp is installed.

In this embodiment, a memory erasure brush is provided in a stage subsequent to transfer. When a bias consisting of about 300 to 800 [Vrms] AC with a frequency of 200 [Hz]to 2 [kHz] superimposed on +200 to −200 [V] DC is applied to memory erasure brush 7, the potentials inside and outside the A4 section become generally matched. Since differences in photosensitive drum 1 fatigue are therefore eliminated, there is no occurrence of step differences in density with half-tone copies. Therefore, when an AC voltage is imposed on the transfer bias voltage, it is preferable to impose an AC bias voltage, and the photosensitive drum 1 potential can be made uniform by memory erasure brush 6.

Next, the bias voltage being applied to the tranasferring brush in paper intervals is considered. In this embodiment, the adhesion of toner on the transferring brush is prevented by changing to a −300 [V] DC bias voltage. Basically, there should be hardly any adhesion of toner to the photosensitive drum in paper intervals, but in practice there is a slight amount of adhesion and in very humid environments in particular the amount increases. Most of the toner that thus adheres in paper intervals has a reverse polarity (+), and the bias voltage for preventing adhesion must be higher than the photosensitive drum during paper intervals. In this embodiment, therefore, the transfer bias voltage in paper intervals is made −300 [V] for a photosensitive drum potential of −500 [V].

In an apparatus which does not possess a light charge removal device, and an AC bias voltage is not applied to a memory erasure brush, it is not possible for an AC bias voltage that is biased with (−) DC greater than the photosensitive drum surface potential to be imposed as an adhesion prevention bias in paper intervals. This is because applying of AC bias voltage results in charging to a potential that is close to the DC bias fraction and the potential cannot be lowered to a potential higher than the charging potential in a scorotron charger.

It is noted that although the description of the embodiment above was given mainly with reference to an example in which a plate-shaped brush is used, the invention is not so limited. As noted earlier, use of the same procedures as in the case of a plate shaped brush to decide the brush thickness, bristle density, bristle foot length, press-in, the element's plate thickness and support angle, etc. makes it possible for the same functions to also be performed when a roller-shaped brush or conductive flexible member is used.

Further, with regard to the developing method, although one-component contact development was used in the description of the embodiment above, other known development method may be employed, and the invention can be similarly applied to other process which use a cleaner.

As described above, a flexible conductive member is used in the transferring device of the invention. This makes it possible to effect good transfer with good efficiency for a long time in a wide range of environments without the cost being made high and with hardly any production of ozone. Further, since the conductive flexible member contacts paper directly at times of transferring of the toner image, paper dust adhering to the paper is efficiently absorbed and removed. Therefore, greatly reducing the load on the cleaning device. Further, the mechanical precision tolerance range is much broader than it is with transferring rollers that have normally been employed in the conventional device. Therefore, it is possible to effect good transfer which is not affected by the paper thickness without complex adjustment mechanisms. The broadening of the mechanical precision tolerance range further means that the operation of moving the transferring device away from the image carrier can be effected easily.

Further, since the jam judgement time $t_1$ when a jam occurs is made shorter than 1/v, it is possible to prevent fouling of the transferring means by a developed image when a jam is detected and the apparatus is stopped. Also in jam recovery operations, the transferring means is kept withdrawn for at least a set time after the start of rotation of the image carrier. It, thus, possible to prevent fouling of the transferring means by transfer residue developer.

What is claimed is:

1. A transferring device in an image forming apparatus, the device comprising:

means for transferring a developed image formed on an image carrier onto an image receiving medium, the transferring means including an plate-shaped member having an elasticity and electrical conductivity to press the image receiving medium to the surface of the image carrier;

means for moving the plate-shaped member of the transferring means between a first position where the plate-shaped member contacts the surface of the image carrier through the image receiving medium and a second position where the plate-shaped member separates from the image carrier;

means for conveying the image receiving medium to the transferring means;

means for detecting a trouble state of the receiving medium conveyed by the conveying means; and means responsive to the detecting means for actuating the moving means to move the plate-shaped member from the first position to the second position within a time $t_1$ (sec) being satisfied by the following formula:

$$t_1 < l/v$$

wherein l [m] represents a length between the detecting means and the transferring means and v [mm/sec] represents a speed for conveying the image receiving medium.

2. A transferring device in an image forming apparatus, the device comprising:

means for transferring a developed image formed on an image carrier onto an image receiving medium, the transferring means including a plate-shaped member produced by mixing conductive carbon and one of urethane rubber and silicone rubber to press the image receiving medium to the surface of the image carrier;

means for moving the plate-shaped member of the transferring means between first position where the plate-shaped member contacts the surface of the image carrier through the image receiving medium and a second position where the plate-shaped member separates from the image carrier; and means for applying a bias voltage to the transferring means.

3. The device according to claim 2, wherein the plate-shaped member of the transferring means includes a conductive brush formed by conductive fibers being bundled in a prescribed density.

4. An image forming apparatus including an image carrier for carrying an electrostatic latent image and means for developing the electrostatic latent image to make a visible image, the apparatus comprising:

means for transferring the developed image from the image carrier onto an image receiving medium, the transferring means including a conductive elastic member to press the image receiving medium to the surface of the image carrier;

means for moving the elastic member of the transferring means between a first position where the elastic member contacts the surface of the image carrier through the image receiving medium and a second position where the elastic member separates from the image carrier;

means for conveying the image receiving medium to the transferring means;

means for detecting a trouble state of the receiving medium conveyed by the conveying means; and means responsive to the detecting means for actuating the moving means to move the elastic member from the first position to the second position and to hold the elastic member in the second position in a time $t_2$ after the trouble state of the receiving medium is recovered, the time $t_2$ (sec) being satisfied by the following formula:

$$t_2 = x/v$$

wherein x (mm) represents a distance between the developing means and the transferring means and v (mm/sec) represents a speed for conveying the image receiving medium.

5. An image forming apparatus including an image carrier to have a developed image formed thereon, the apparatus comprising:

means for transferring the developed image from the image carrier onto an image receiving medium, the transferring means including a conductive elastic member produced by mixing conductive carbon and one of urethane rubber and silicone rubber to press the image receiving medium to the surface of the image carrier;

means for moving the elastic member of the transferring means between a first position where the elastic member contacts the surface of the image carrier through the image receiving medium and a second position where the elastic member separates from the image carrier;

means for conveying the image receiving medium to the transferring means;

means for detecting a trouble state of the receiving medium conveyed by the conveying means;

means responsive to the detecting means for actuating the moving means to move the elastic member from the first position to the second position; and means for applying a bias voltage to the transferring means.

6. The device according to claim 5, wherein the elastic member of the transferring means includes a conductive brush formed by conductive fibers being bundled in a prescribed density.

* * * * *